United States Patent [19]

Hilmersson

[11] 4,384,438

[45] May 24, 1983

[54] ARRANGEMENT ON PACKING MACHINES

[75] Inventor: Anders E. Hilmersson, Helsingborg, Sweden

[73] Assignee: Tetra Pak International AB, Lund, Sweden

[21] Appl. No.: 166,388

[22] Filed: Jul. 7, 1980

[30] Foreign Application Priority Data

Jul. 25, 1979 [SE] Sweden ..... 7906350

[51] Int. Cl.[3] ..... B65B 57/04

[52] U.S. Cl. ..... 53/51; 53/551; 53/552

[58] Field of Search ..... 53/51, 389, 551, 552; 226/24, 38, 108, 115, 34, 10, 126, 139, 162; 493/11, 29

[56] References Cited

U.S. PATENT DOCUMENTS

| | | | |
|---|---|---|---|
| 2,385,229 | 9/1945 | Patterson | 53/551 X |
| 2,483,155 | 9/1949 | Salfisberg | 53/51 |
| 2,636,731 | 4/1953 | Howard | 53/551 X |
| 3,449,888 | 6/1969 | Gausman | 53/552 |
| 3,629,987 | 12/1971 | Klopfenstein et al. | 53/51 X |
| 3,680,446 | 8/1972 | James et al. | 53/51 X |
| 3,788,028 | 1/1974 | Folkesson et al. | 53/51 |
| 4,009,551 | 3/1977 | Greenawalt et al. | 53/51 X |
| 4,067,170 | 1/1978 | Yates, Jr. | 53/51 X |
| 4,081,944 | 4/1978 | Sjöstrand | 53/51 |

FOREIGN PATENT DOCUMENTS

| | | | |
|---|---|---|---|
| 1504662 | 3/1978 | United Kingdom | 53/51 |

*Primary Examiner*—Horace M. Culver

*Attorney, Agent, or Firm*—Burns, Doane, Swecker & Mathis

[57] ABSTRACT

The invention relates to a regulating arrangement in particular on packing machines for the feed of weblike packing material in register with decorations or folding indications, so-called crease lines, present on the web. In accordance with the invention the desired control is obtained by regulating the tension of the web with the help of a guide roller over which the web is passed. The speed of the guide roller is regulated so that a web tension required for a feed according to register is obtained.

7 Claims, 3 Drawing Figures

ARRANGEMENT ON PACKING MACHINES

BACKGROUND AND SUMMARY OF THE PRESENT INVENTION

The present invention relates to an arrangement for the feed of weblike packing material in register with decorations or crease lines present on the packing material web.

In the manufacture of packages, weblike packing material is often used which can be stored in magazine rolls. In automatic packing machines the weblike packing material is converted to filled and closed packing containers, the packing material web being formed to a tube in that the edges of the web are joined together. The tube then is filled with the intended contents and flattened and sealed along narrow sealing zones situated at a distance from one another, these sealing zones extending transversely across the tube. The said sealed tube portions can be shaped to packing containers in connection with or after the sealing by folding of the packing material, and it is customary to impart to the packing container which has been manufactured in the abovementioned manner a parallelepipedic shape by enclosing the lower part of the packing material tube in shaping elements which fold the packing material along crease lines arranged in advance. The crease lines facilitate the folding at the same time as triangular, double-walled lugs are formed at the lower side edges of the packing container.

Since the packing material web in general is provided with a decoration of an advertising or informative character, and also with crease lines to facilitate the folding, it is necessary to advance the packing material tube formed, and hence also the packing material web, with great precision so that the packing decoration will be placed correctly on the packing container and the crease line pattern will coincide with the position of the shaping elements. It is known that such a feed of a packing material web in register with decorations and crease line pattern can be carried out by using so-called folding flaps during the shaping of the abovementioned double-walled triangular lugs, which flaps are formed during the shaping by folding of parallelepipedic containers. The said folding flaps can be made to perform different working motions, that is to press together the triangular lugs to a varying degree depending on the pick-up of a register-holding mark arranged on the packing material web. If more material is to be advanced the flap is moved to its bottom position, otherwise the movement of the flap is stopped before it has reached its bottom position. Such a regulating system is described in Swedish Pat. No. 315.236 and has been found to operate well, but since a small difference in volume will exist between a "compensated" and a "non-compensated" package, the flap movement must not be made too great, since otherwise the volume difference or volume spread may become unacceptable. As the development moves towards more and more rapidly working packing machines, and the increasing speed gives rise to technical problems which means among other things that the capacity of the machine to maintain the decoration diminishes, for example, because of increased acceleration of the paper and movement of the liquid in the tube, the need arises for a safer and better feed regulator.

In accordance with the present invention this technical problem and others are solved with the help of a guide roller driven at variable speed over which the packing material web passes, and by movable elements which are adapted so that they periodically engage the packing material web and advance the web. A further characteristic of the invention are elements for determining the position of the advanced web in relation to the decoration or the crease line pattern arranged on the web, and elements for controlling the speed of the guide roller as a function of the determined web position so that the mechanical tension in the web after the guide roller can be regulated.

BRIEF DESCRIPTION OF THE DRAWINGS

An embodiment of the invention will be described in the following with reference to the enclosed schematic drawing, wherein like members bear like reference numerals, and wherein.

DETAILED DESCRIPTION OF THE PREFERRED EMBODIMENTS

Figure 1:
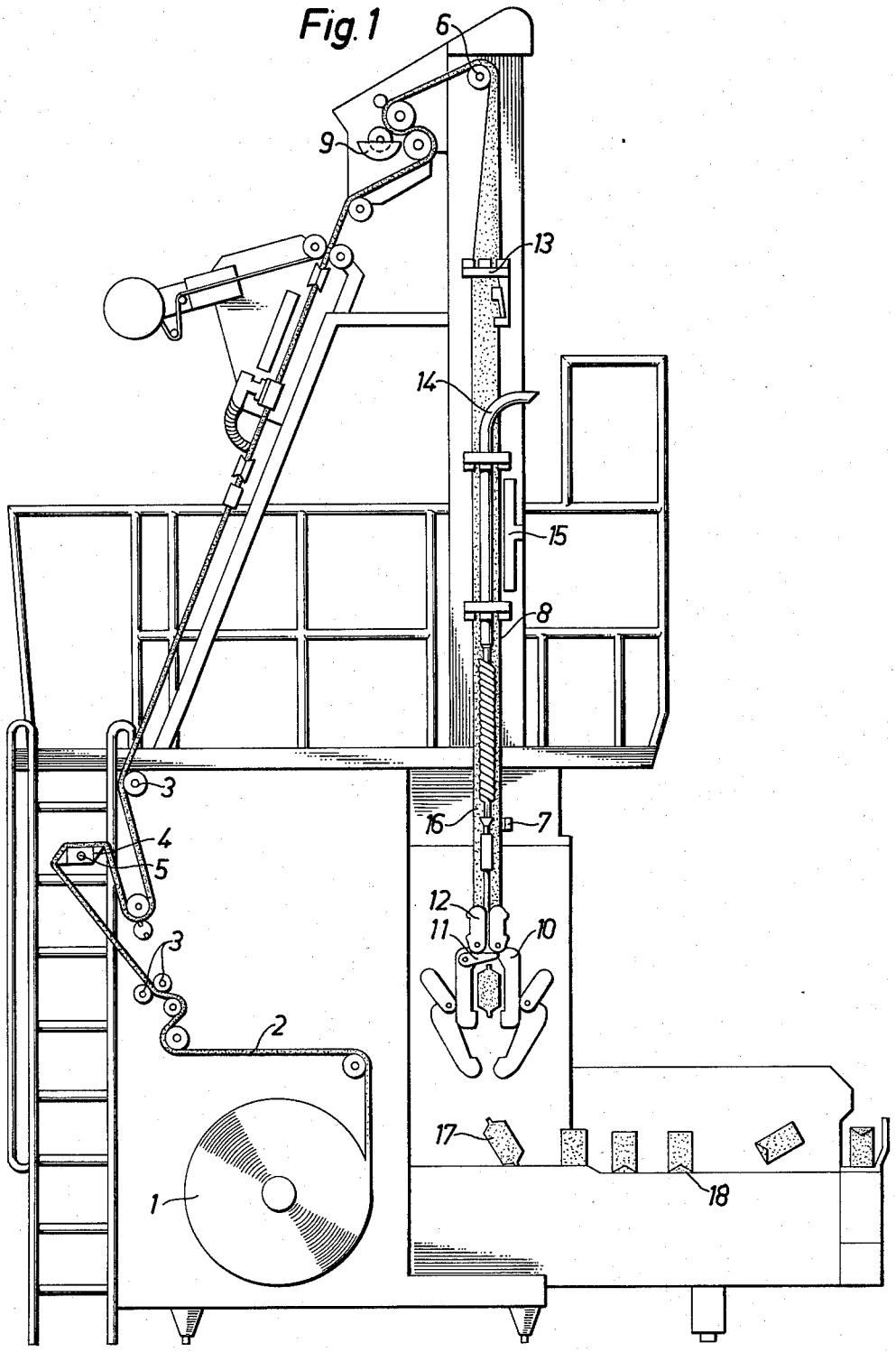
FIG. 1 is a schematic view of an automatic packing machine for the manufacture of parallelepipedic packing containers.

In the description given in the following of an embodiment of the invention it is assumed that the arrangement in accordance with the invention is used in connection with an automatic packing machine of the type which is marketed under the trade name TETRA BRIK®. It is, of course, also possible to apply the invention to other types of automatic packing machines, but since the invention is intended first and foremost to be used in conjunction with TETRA BRIK® machines we chose to describe the invention as it is used in combination with the said type of machine.

The packing machine (FIG. 1) comprises a magazine roll 1 of weblike packing material which may consist e.g. of plastic-coated paper or cardboard, but a more complicated laminate containing a metal foil layer, plastic layers of different types, foamed plastic layers, etc, may also be used, depending on the demands which are made on gas tightness, fat resistance, etc. The web 2 rolled off the magazine roll 1 may be provided in advance with a decoration and in the case described here also with a pattern of crease lines impressed in the material web to facilitate the shaping by folding. In certain cases the packing material web is also provided, in particular in its edge zone, with printed markings adapted to be sensed by a photo-electric device (photocell), the said printed markings being arranged on the web at a distance from one another which distance corresponds to the length of a package division or multiples of a package division. Moreover, the said printed markings are placed in a fixed relationship to the decoration and crease line pattern.

In order to keep the web 2 stretched, the web passes over an arrangement of guide rollers 3, whereupon it is passed over an arrangement 4, adapted to rotate, and consisting of a "winch", which in the preferred embodiment is of a rectangular cross-section and which rotates about an axle 5. The said arrangement or "winch" 4 is provided with relatively accentuated corner points which are adapted so that they can be made to engage with the transverse crease line pattern arranged on the web, the distance between the four edges of the "winch" having to correspond of course to the distance between the crease lines on the packing material web 2.

It has been found that an arrangement of the type described here will engage with the crease line pattern in the packing material web 2, and that the transverse creases in the packing material web will be bent over the edges of the "winch". By this process two objectives are accomplished: On the one hand the transverse creases on the packing material web 2 will be prefolded or "opened up", which means that the subsequent shaping operation is appreciably facilitated. Moreover, and this is important in the context described here, the "winch" 4 will rotate about the axle 5 synchronously with the transverse crease line pattern, which in turn is synchronous with the decoration printed onto the web. In this way, the angular position of the "winch" 4 provides a measure of the position of the crease line pattern and the decoration at the shaping elements 10, since the length of the web 2 between the "winch" 4 and the shaping elements 10 is constant. Thus it is possible, for example, when crease line pattern and decoration position are correct at the shaping elements 10, to observe the position of the "winch" 4 when the sealing jaws 11 are in their lower closed position. If the "winch" 4 is in an angular position different from the one mentioned earlier, the decoration is obviously not correctly adapted to the shaping elements 10, which means that the shaping is made more difficult, since the crease line pattern has not been placed correctly in relation to the folding flaps of the shaping elements 10, and that the decoration on the package is incorrectly placed.

The variation of the angular position of the "winch" 4 thus provides a measure of "deficient agreement" between the decoration and crease line pattern of the web and the movement of the shaping elements. This deviating angular position can be used therefore to control the web feed so that crease line pattern and decoration are adapted again to the location and movement of the shaping elements 10. It would be possible, for example, in a known manner to allow the "winch" 4 to control folding flaps, not shown in FIG. 1, which constitute part of the shaping elements 10. As mentioned previously, it is possible with the folding flaps to press together wholly or partly the double-walled triangular lugs formed during the shaping by regulating the movement of the folding flap. When the folding flap is dropped down to a lower position, more material is advanced than when the folding flap is in its upper position. In this manner, by movement of the folding flap, it is possible to set a variable feed of the web 2 between 0.1 and 2 mm. If the movement of the folding flap, and consequently, the adjustment, is too small, the regulating range will be small, and there is a risk of dropping "out of register", that is to say, the range of regulation is smaller than the variations in feed which may occur. On the other hand, if the movement of the folding flap is too great, variations in volume between different packages will occur and such a "volume spread" can only be accepted within very narrow limits.

The movement of the said folding flaps, by means of which the adjustment of the web feed can be achieved, can be controlled by the "winch" 4 in such a manner than an electric contact which is attached to the "winch" 4 gives off a pulse if the angular position of the "winch" 4 shows that too little paper is advanced. As a result the folding flaps are dropped down to their bottom position during one or more shaping cycles so that more packing material is advanced and the angular position of the "winch" is returned to normal. When this has taken place, no more signals are given off by the "winch" and the folding flaps return to stop in their upper position and a little less packing material will then be advanced. Naturally, the regulating device can also be adapted so that the normal feed position of the folding flaps is the one where folding flaps are fully dropped and that folding flaps stop in their upper position, that is to say, feed less packing material, if the "winch" 4 picks up and gives a signal that too much packing material is being advanced. Arrangements of this general type for providing adjustability of the closing position of the folding flaps are described in greater detail in U.S. Pat. Nos. 3,325,961 issued June 20, 1967 to Lindh et al and 3,417,674 issued Dec. 24, 1968 to Abrahamson.

If the packing material web 2 is elastic, the "winch" 4 must be placed more closely to the shaping elements 10 than as shown in FIG. 1, and preferably as close to the upper guide roller 6 as possible. As mentioned earlier it is also possible instead of the "winch" 4 to use a photoelectric pick-up or sensing device 7 which detects markings 8 printed on the web. The pulses which are given off by the photoelectric device 7 on detecting the markings 8, or the absence of such detection, may be used in the manner described earlier for controlling the folding flaps by means of which a "feed adjustment" of the web can be performed.

From the "winch" 4 the web 2 passes over further guide rollers 3 up towards the top guide roller 6. In the illustrated embodiment, the web is conducted through devices 9 for the application of a sterilizing agent, since the machine illustrated here is intended for the packing of sterile contents, and the web 2 then passes over a top guide roller 6. After the web has passed this guide roller 6, the web 2 is led vertically downwards while being converted at the same time to a tube 16, which is done with the help of shaping rings 13. The contents are introduced into the tube through a filler pipe 14 and the longitudinal edges of the web 2 are sealed to one another with the help of a sealing device 15 so that the tube formed will be provided with a longitudinal, tight sealing joint. By means of the shaping elements 10 the tube 16 filled with contents is shaped to parallelepipedic packing containers 17. The shaping procedure in principle consists in that a pair of co-operating shaper halves 12 is closed around the tube 16 which in the process is folded along longitudinal crease lines and is thus given a rectangular cross-section. The sealed lower end of the tube is then compressed or folded to a plane end wall with the help of the transverse crease line pattern, the said double-walled triangular lugs are formed, and these lugs are pressed together by the folding flaps. When the lower part of the packing container has thus been formed, the tube 16 is gripped and flattened above the shaper halves 12 by sealing jaws 11, by means of which the tube 16 is sealed along a narrow sealing zone at the same time as the shaping elements 10 move inwards and downwards to form a plane end wall along which runs a sealing fin, whereupon a second pair of shaper halves closes over the sealed tube portion, which is then severed in the sealing joint and is transported to a so-called end folder 18, where the triangular lugs are sealed to the side and end walls of the packing container.

In accordance with the present invention the upper guide roller 6 is driven by a motor with variable speed. This regulator motor is controlled by the pulses which are given off by the "winch" 4 or by the photoelectric device 7. The regulator function itself will be described in detail in the following and the regulation on the whole has the object of regulating with the help of the driven guide roller 6 the tension in the part of the web 2 and the tube 16 present between the guide roller 6 and the shaping elements 10. If the pick-up device 4 or 7 emits a signal that more packing material has to be fed, a signal is given off to the driving motor of the guide roller 6 whose speed is increased, which means that the mechanical tension in the walls of the tube 16 diminishes, and this means in accordance with what will subsequently be described, that more packing material will be advanced.

Figure 2A:
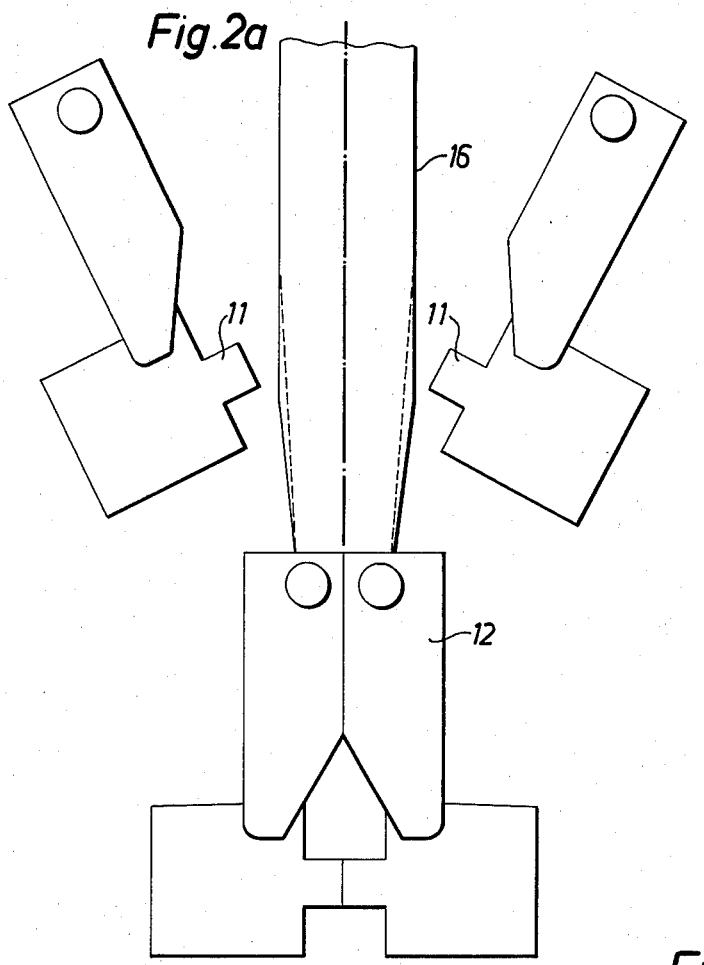
FIG. 2*a* and 2*b* are schematic views of the movement of shapers and sealng jaws on a packing machine.

With reference to FIG. 2*a*, a pair of sealing jaws is swung inwards towards the tube 16 at the same time as the tube 16, together with the shaper halves 12 in engagement with the tube 16, is in a vertical downwards movement. The movement of the sealing jaws 11 is fully controlled by means of cams relative to the downwards movement of the shaper halves 12, and the sealing jaws 11 will thus always close around the tube 16 in the same manner and with the same movement, which means in principle that all packing containers will be of the same size, since the lower tube portion, whose bottom has already been shaped, is held fast between the shaper halves 12. It has been found, however, that a small variation of the so-called takeoff length, that is to say, the distance along the tube between two sealing zones, can be obtained when the tension in the tube is increased. It is true that the movement of the sealing jaws 11 is completely fixed in relation to the lower shaper halves 12, but if the tension in the tube increases, it is possible, as shown in FIG. 2*a*, that the position of the tube wall is altered a little, i.e. the tube can become more or less "conical". In this way, the engagement of the sealing jaws 11 on the tube will not be exactly the same as when the tube is non-stretched or more "widened out". As it has been found that the engagement of the sealing jaws and the flattening of the tube take place without any slipping whatever against the outside of the tube, it will be readily understood that the sealing jaws 11 will strike the tube at different points, depending on whether the tube is stretched or not. If the tube is stretched, the sealing jaws 11 will strike the tube later, that is to say, above the spot on the tube which the sealing jaws would strike if the tube had not been stretched, and therefore the so-called "takeoff length" will be increased and more material will be advanced.

Figure 2B:
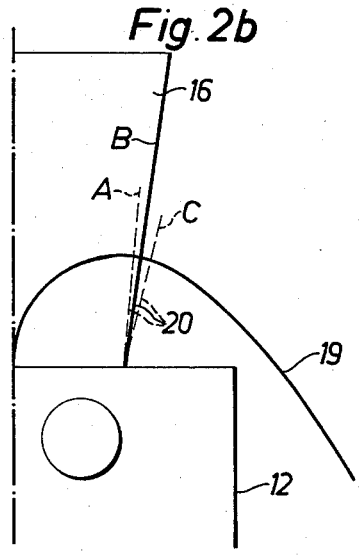

In FIG. 2*b*, which shows the tube 16 and the upper portion of the shaper parts 12 surrounding the tube, a curve 19 represents the movement of the sealing jaws 11 in relation to the tube 16 and the shaper halves 12. Moreover, broken lines 20 represent the position of the tube wall at different degrees of stretching of the same. As is evident from the figure, the sealing jaw 19 will strike the tube at different points A, B and C depending on the extent of stretching or tension of the tube 16, which as mentioned above, means that the "takeoff length" of the tube will be altered.

The characteristic described above has been made use of in accordance with the present invention so as to achieve a regulation of the tube and web feed in order to keep the decoration and crease line pattern adapted to the shaping elements 10 on the packing machine. This regulator system may be used on its own, that is to say, the folding flaps mentioned earlier which have been used up to now need not be provided with any control, but rather the whole regulation of the web feed can be done by the driven top guide roller by means of which the tension in the web and the tube can be regulated. However, it has been found that in modern high-speed machines the widest possible regulating range is desirable, and it has been found that in the present case it is appropriate to combine the regulating device known and used up to now, which uses folding flaps, with the new regulating system, which is based on a control of the mechanical tension in the web and tube with the help of a driven guide roller. As will be described in the following, the said regulator systems can readily be made to co-operate in a reliable manner to increase the regulation range without thereby diminishing the accuracy of volume of the packages.

Referring back to FIG. 1 it will readily be understood that a force is required for drawing packing material web 2 off the magazine roll 1 with the help of the movable shaping elements 10, and that the force used for this must be generated by the shaping elements 10, if the upper guide roller 6 is not driven. The force required for drawing the web along will depend, however, on a number of factors, such as e.g. the diameter of the magazine roll 1, the stiffness of the packing material, the moisture and of course factors such as the friction of the guide rollers, etc. This means that the tension in the tube 16 is different for different machines and that it may also vary for one and the same machine when e.g. the size of the magazine roll 1 is altered. This means that a change in the "takeoff length" or length of the package will automatically be obtained which change will increase as the tension in the tube becomes higher. If the upper guide roller 6 is not driven, this fluctuation in "takeoff length" or package length must be compensated with the help of the folding flaps which means that a part of their regulating range will be taken up by the regular need for regulating arising e.g. from changes in diameter of the magazine roll.

However, if the upper guide roller 6 is driven, an additional force can be provided with the help of the guide roller, the maximum value of which depends on the encircling angle of the web and on the coefficient of friction between web and guide roller. Since the shaping elements 10 move relatively fast during part of the progress of the feed, the guide roller must be freerunning, so that it can move faster than it is driven, but at the end of the feed movement of the shaping elements the rate of feed will be less, so that the driving motor once again has to drive the guide roller, which will then contribute to the force which is required for drawing forth the packing material. When the guide roller is driven, the mechanical tension in the tube diminishes. As mentioned, the contribution to the feed force, which can be provided by the upper guide roller, is limited by the fact that the driven guide roller on reaching a certain force will slip against the web 2, and the limits within which the upper guide roller can contribute to a regulation of the tension in the tube 16 can thus be said to range from zero to the force at which slipping occurs. It is conceivable to increase the scope of regulation further by not using freewheeling operation on the guide roller, but driving the same at a fixed speed, which means in principle that it would be possible for the tube tension to be increased beyond the value which is attained with a "passive guide roller", since the guide roller at a rotation slower than that corresponding to the feed of the shaping elements makes a negative force contribution, i.e. it increases the tension in the tube. However, such an arrangement on the machine described here might bring about certain difficulties in connection with the faster feed movement of the shaping elements, giving rise to excessive stresses in the web and tube and consequently, rendering more difficult the formation of the tube.

Thus it is possible, by variation of the speed of the upper guide roller 6, to vary within certain limits the tension of the tube 16. The driving motor of the guide roller 6 may be controlled e.g. with the help of an arrangement which picks up the frequency of control pulses from devices 4 or 7 which scan the decoration or crease line pattern. The said frequency of control pulses can be integrated and transduced to a direct current supplying the driving motor of the guide roller. If the frequencies of control pulses, that is to say, pulses from the pick-up device, emit a signal indicating that too little material is fed, the d.c. voltage given off by the regulator device increases and the speed of the motor of the guide roller will increase and more material will be advanced.

By combining the two regulating arrangements in the manner described earlier it is possible e.g. to set the regulator device in such a manner that the desired driving speed of the roller is attained at 50% pick-up frequency. In this way the folding flaps which co-operate with the tube tension regulator are adapted to operate at every other feed cycle. In this case it can be said that the folding flaps operate in the middle of their regulating range or in other words the regulating range can be extended to encompass the extreme cases of advancing more material at each feed cycle or not advancing material during any feed cycle. By allowing the regulating frequency of the control flaps to act upon the regulating device of the guide roller, it is endeavoured to maintain the web tension at the level where the folding flaps are made to operate every other time, that is to say, in the middle of their regulating range. This implies that the whole of the operating range of the guide roller regulator is used in the endeavour to keep the folding flap control in the middle of its regulating range, and only after the regulating range of the guide roller regulator has proved to be insufficient, the regulating range of the folding flap regulator is used. The joined systems thus provide a substantially enlarged regulating range.

With the help of the guide roller regulator the speed range can be adjusted for different types of packing material, e.g. material of different stiffness and coefficient of friction, so that a suitable regulating range is obtained. The regulating range for the speed of the guide roller naturally depends on the capacity and the rate of feed of the packing machine, but as an example it may be mentioned that in the type of machine described here a peripheral speed of $\pm 35\%$ of the nominal web speed has proved to be a suitable regulating range.

As mentioned earlier it is possible to use the web and tube tension regulator on its own and allow the whole regulation to be performed by the drive of the upper guide roller, but it has been found appropriate, at least on machines which previously had the known folding flap regulation, to combine the systems so that in this manner an enlarged regulating range results, though without The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the invention. Accordingly, it is expressly intended that all such variations and changes which fall within the spirit and scope of the present invention as defined in the appended claims be embraced thereby.

What is claimed is:

1. Apparatus for continuously feeding a packing material web with respect to the position of decorations or crease lines present on the packing material web, comprising a guide roller driven in one direction at variable speed over which passes the packing material web, means for converting the web to a tube by joining longitudinal edges of the web, movable elements which are adapted for periodically engaging the packing material web for advancing the web, sensing means for determining the position of the web by reference to the decorations or the crease lines, said sensing means being arranged between said guide roller and the movable elements, and means for controlling the speed of the guide roller as a function of the determined position of the web to regulate mechanical tension in the web after passing the guide roller such that the movable elements engage the packing material web at the proper location.

2. Apparatus in accordance with claim 1 including cooperating sealing jaws for flattening and sealing the tube along repeated narrow zones situated at a distance from one another, said zones being substantially at right angles to a longitudinal axis of the tube, said movable elements for advancing the packing material web comprise the sealing jaws adapted to be movable and to cooperate in pairs, and wherein the sensing means for determining the position of the advanced web comprises a photoelectric device for scanning control marks printed onto the packing material web.

3. Apparatus in accordance with claim 2, further comprising a first control device having flaplike elements which press portions of the tube together in connection with the shaping to packing containers and simultaneously feed the tube, said flaplike elements having two operating positions defining a regulating range, in one position a little more web material is fed than in the other position, and said flaplike elements being controlled to either of the two operating positions as a function of the sensing means for determining the position of the web.

4. Apparatus in accordance with claim 3, further comprising a second control device for transducing control pulses obtained from the sensing means for determining the position of the web to control said flaplike elements into a control signal which is adapted to act upon a third control device for controlling a voltage supplied to a driving motor of said guide roller to control the speed of the driving motor.

5. Apparatus in accordance with claim 3, wherein said flaplike elements and said guide roller driven at a variable speed are adapted to co-operate, the speed regulator of the guide roller being adapted to drive the guide roller at such a speed that the mechanical tension in, and the deformation of, the tube resulting from the speed of the guide roller, are such that the flaplike elements will operate in the middle of the regulating range.

6. Apparatus according to claim 1, wherein the sensing means for determining the position of the web comprises a mechanical device for scanning the location of the crease lines provided in the packing material web to facilitate shaping of the web.

7. Apparatus according to claim 5, wherein approximately fifty percent of the movement of the flaplike elements occurs in each of the operating positions.

* * * * *